United States Patent [19]

Giarratana

[11] Patent Number: 4,974,523

[45] Date of Patent: Dec. 4, 1990

[54] AUXILIARY PRODUCE-COUNTER SHELF

[76] Inventor: Eugene R. Giarratana, 416 Benedict Ave., Tarrytown, N.Y. 10591

[21] Appl. No.: 298,420

[22] Filed: Jan. 18, 1989

[51] Int. Cl.[5] ..... A47B 23/00

[52] U.S. Cl. ..... 108/42; 211/188

[58] Field of Search ..... 108/42, 46, 47, 48, 108/27, 90, 92, 93, 99, 60, 64, 108; 211/113, 117, 128, 90, 88

[56] References Cited

U.S. PATENT DOCUMENTS

| | | | |
|---|---|---|---|
| 493,596 | 3/1893 | McLeran | 211/117 |
| 858,112 | 6/1907 | Smart | 108/42 |
| 1,147,505 | 7/1915 | Henigson . | |
| 1,243,059 | 10/1917 | Friesleren | 211/90 |
| 1,950,204 | 3/1934 | Wood et al. | 211/117 X |
| 2,438,443 | 6/1946 | Jermyn . | |
| 2,687,336 | 8/1954 | Smith et al. | 108/47 X |
| 2,932,544 | 4/1968 | Lambert | 108/47 X |
| 3,125,040 | 3/1964 | Roberson | 108/47 X |
| 3,193,848 | 7/1965 | Levy | 108/48 X |
| 3,393,809 | 1/1967 | Brown et al. . | |
| 3,901,165 | 8/1975 | Schlesinger | 211/113 X |
| 3,905,484 | 9/1975 | Dean et al. | 108/60 X |
| 4,243,279 | 1/1981 | Ackeret | 108/64 X |
| 4,244,301 | 1/1981 | Nakatsu . | |
| 4,576,293 | 3/1986 | Hinton . | |

*Primary Examiner*—Jose V. Chen

*Attorney, Agent, or Firm*—Jay H. Maioli

[57] ABSTRACT

An auxiliary shelf is adapted to be added to an existing refrigerated produce counter and is provided with a mounting bracket to be attached near the upper edge of the mirror typically found in such produce counters. The shelf is suspended by monofilament lines that are adjustable so that the angle formed between the shelf and the mirror at the back of the produce counter can be varied. Standoffs are formed at the rear of the auxiliary shelf to permit cooled air to flow behind the auxiliary shelf and, when the shelf is formed with perforations, such air flow occurs through the shelf as well. The auxiliary shelf may be advantageously formed of plastic and such plastic may be transparent or translucent to improve the appearance thereof and dividers or partitions can be added to the shelf as desired.

16 Claims, 5 Drawing Sheets

AUXILIARY PRODUCE-COUNTER SHELF

BACKGROUND OF THE INVENTION

1. This invention relates generally to merchandise shelves and, more particularly, to an auxiliary shelf specifically intended for use with existing refrigerated produce counters.

2. Description of the Background

Refrigerated produce counters are well-known and almost universally employed in supermarkets throughout the world. Typically such refrigerated producer counters provide an angled, waist-level tray or counter supporting the produce and have a mirror vertically arranged behind the counter to better display the goods. The mirror is arranged at an angle slightly less than 90° relative to the produce counter in order to permit the consumer to better view the goods. Cooled air is generated by a refrigeration unit and is circulated both beneath and through the tray supporting the produce as well as up and behind the mirror so that the cooled air exits at suitable outlets or vents at the top of the mirror and flows down along the mirror and onto the produce. The cool air then passes through the vents in the produce counter and is recirculated.

Generally, only the main, slanted produce tray is available for display of the merchandise. Thus, useful space above the main tray that could otherwise be advantageously employed is wasted. In the case of refrigerated produce counters employing two shelves, such second shelf is always a solid rigid shelf firmly affixed to the framework of the refrigerated counter and is not adaptable for various uses.

Thus, there exists a large amount of space that could otherwise be employed for displaying merchandise that is presently being wasted. Furthermore, there are no add-on shelves known for use that can utilize this wasted space. Known secondary shelves are not adaptable for additional purposes and are not useful in modifying existing single shelf refrigerated produce units.

OBJECTS AND SUMMARY OF THE INVENTION

Accordingly, it is on object of the present invention to provide an auxiliary produce-counter shelf for use in modifying an existing refrigerated produce counter that can eliminate the above-noted defects inherent in the prior art.

Another object of this invention is to provide an auxiliary shelf that is light in weight and easily mounted to the existing mirror of the refrigerated produce counter without major hardware and labor expenditures.

A further object of this invention is to provide an auxiliary produce-counter shelf that is suspended from the upper edge of the existing mirror by lines so as to provide an adjustable shelf angle and wherein the shelf is provided with standoffs to permit the flow of refrigerated air down along the mirror surface and over the produce in the main produce-counter tray.

In accordance with an aspect of the present invention, an auxiliary produce-counter shelf is formed of strong, lightweight plastic, which may be transparent or translucent, and includes a mounting bracket that can mount the shelf to the top edge of any mirror presently being utilized in a refrigerated produce counter. The lines that suspend the shelf from the mounting bracket are adjustable so that the auxiliary shelf forms either a right angle with the existing mirror and is substantially parallel to the existing shelf or is at an angle of approximately 30° with the existing mirror so as to be parallel to the floor. Mating engaging elements are formed at each end of the auxiliary shelf so that a number of such shelves can be interconnected and suspended above a long length of refrigerated produce counter. In order to maintain the original design of the refrigerated produce counter relating to the flow of cooled air over the produce, the auxiliary shelf is provided with standoffs that separate the shelf from the mirror surface and permit such cooled air flow to be uninterrupted. In order to provide a stable shelf, suction cups may be placed at the outer ends of the standoffs for abutting the mirror surface.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENTS

Figure 1:
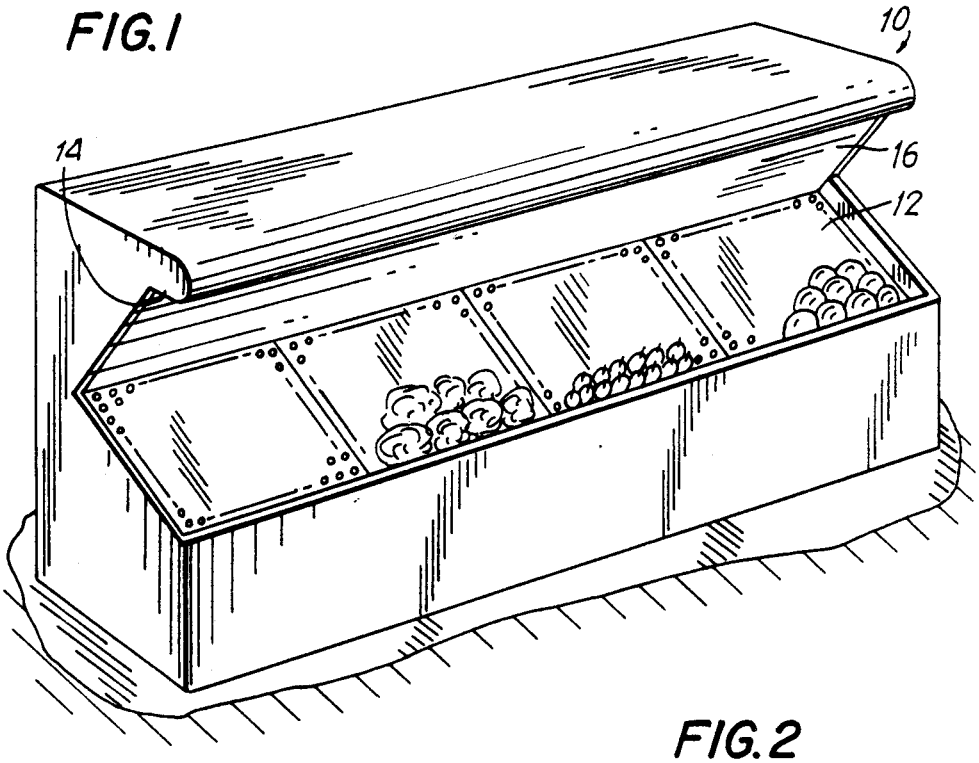
FIG. 1 is a perspective view of a known refrigerated produce counter.

FIG. 1 represents a standard, commercially available, refrigerated, produce display counter 10 in which racks or shelves 12 are provided to support the produce for display. An upper or overhead portion 14 of produce counter 10 may include lights for illumination, as well as outlet vents for the cooled air that is forced over the produce in order to keep it fresh. In addition, arranged at an angle behind the shelves 12 are one or more slanted mirrors 16 that both enhance the appearance of the produce display and also increase the general brightness of the produce counter 10. As may be seen in FIG. 1, the area immediately above the produce on display and shelves 12 is generally wasted from the standpoint that additional shelves could be arranged at that location. As noted above, one problem has been that it is difficult to arrange shelves at that location due to the mirror not providing a suitable attachment surface and, further, any permanent shelves that were added would limit access to the main produce supporting shelves 12 and would also restrict the amount of produce that could be placed on the main shelf.

Figure 2:
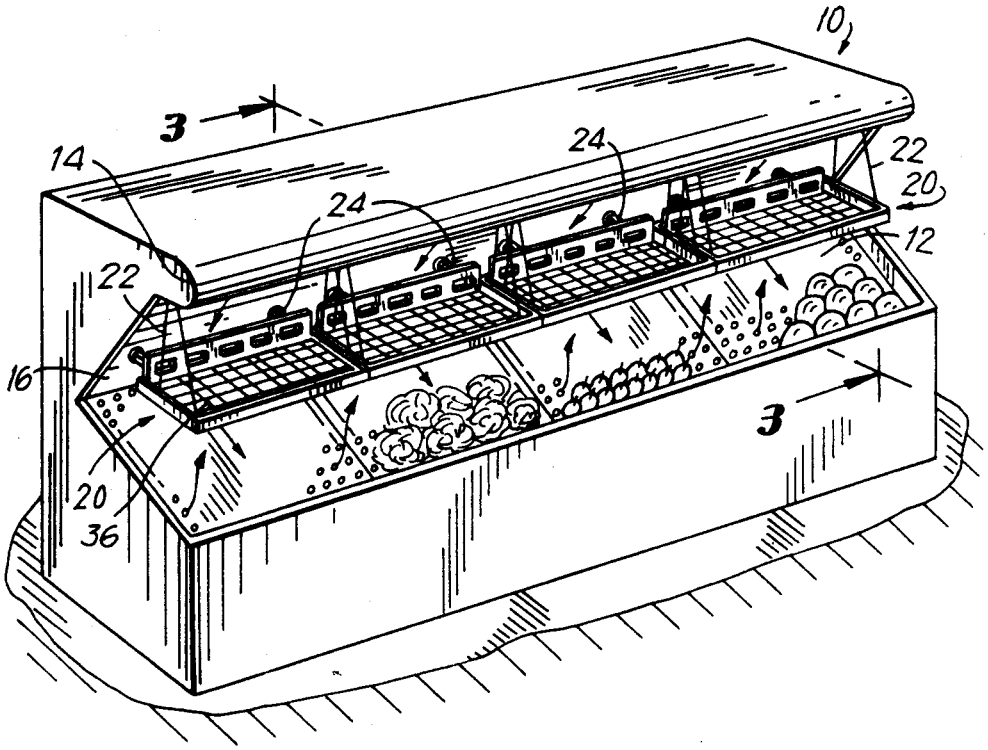
FIG. 2 is a perspective view of a refrigerated produce counter having a plurality of the inventive auxiliary shelves installed thereon.

FIG. 2 shows the refrigerated produce display counter 10 of FIG. 1 having a number of the auxiliary shelves according to the present invention installed thereon and shown typically at 20. These shelves 20 are suspended from brackets (not shown in FIG. 2) that attach to the support for the upper edge of mirror 16 and each shelf 20 is then suspended by individual cords, which in the instant embodiment comprise nylon monofilament lines, shown typically at 22. There are a pair of monofilament lines 22 at each end of each auxiliary tray 20. Each auxiliary tray 20 is provided with two standoffs, shown typically at 24, which have in this embodiment rubber tips formed by suction cups on the ends to abut the mirror 16 and thereby provide stability to the suspended tray. In addition, as will be discussed hereinbelow, each tray has a suspension adjusting feature that permits the angle of the tray to be changed at least from a position substantially horizontal to the floor to a position that is substantially parallel to the slanted produce shelf 12. Other angular positions of the shelf are also contemplated by the present invention.

Figure 3:
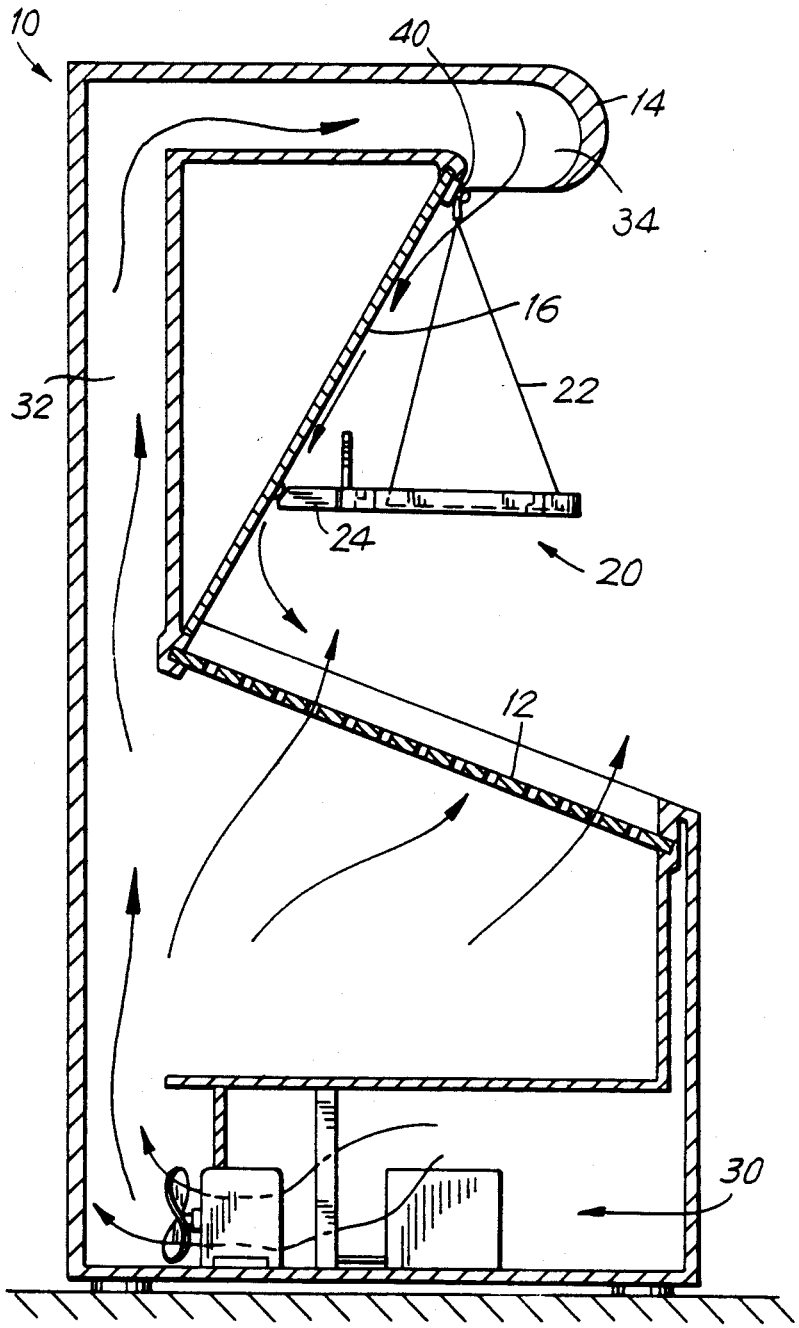
FIG. 3 is a cross-sectional view of the produce counter of FIG. 2 taken along section lines 3—3 therein and showing the manner in which the inventive shelf is suspended in a first position.

FIG. 3 is a cross-sectional view of the refrigerated produce counter 12 of FIG. 2 taken along section lines 3—3. As shown in FIG. 3, the space existing in the refrigerated counter 10 that is located behind and beneath the angled mirror 16 and produce shelf 12, respectively, is substantially open in order to permit circulation of the cooled air over the produce items arranged on shelf 12. More specifically, arranged in the base 30 of refrigerated produce counter 20, are a refrigeration unit and fan and the like (not shown) that produce cooled air that flows up through the channel 32 behind mirror 16 and out through one or more outlets, shown generally at 34, so that the cold air can flow down along mirror 16 and onto the produce arranged on tray 12. Accordingly, it is an important feature of the present inventive auxiliary tray 20 that standoff elements 24 be of a sufficient length so as not to impede this cooled air flow down the surface of mirror 16. Additionally, the present tray is provided with slots or surface openings, shown typically at 36 in FIGS. 2 and 5, to further prevent impeding the cooled air flow. As will be noted in the embodiment of the inventive auxiliary shelf 20 shown in FIG. 3, the monofilament lines 22 are adjusted so that the inventive tray 20 is arranged parallel to the floor, that is, at an angle to slanted mirror 16.

Figure 4:
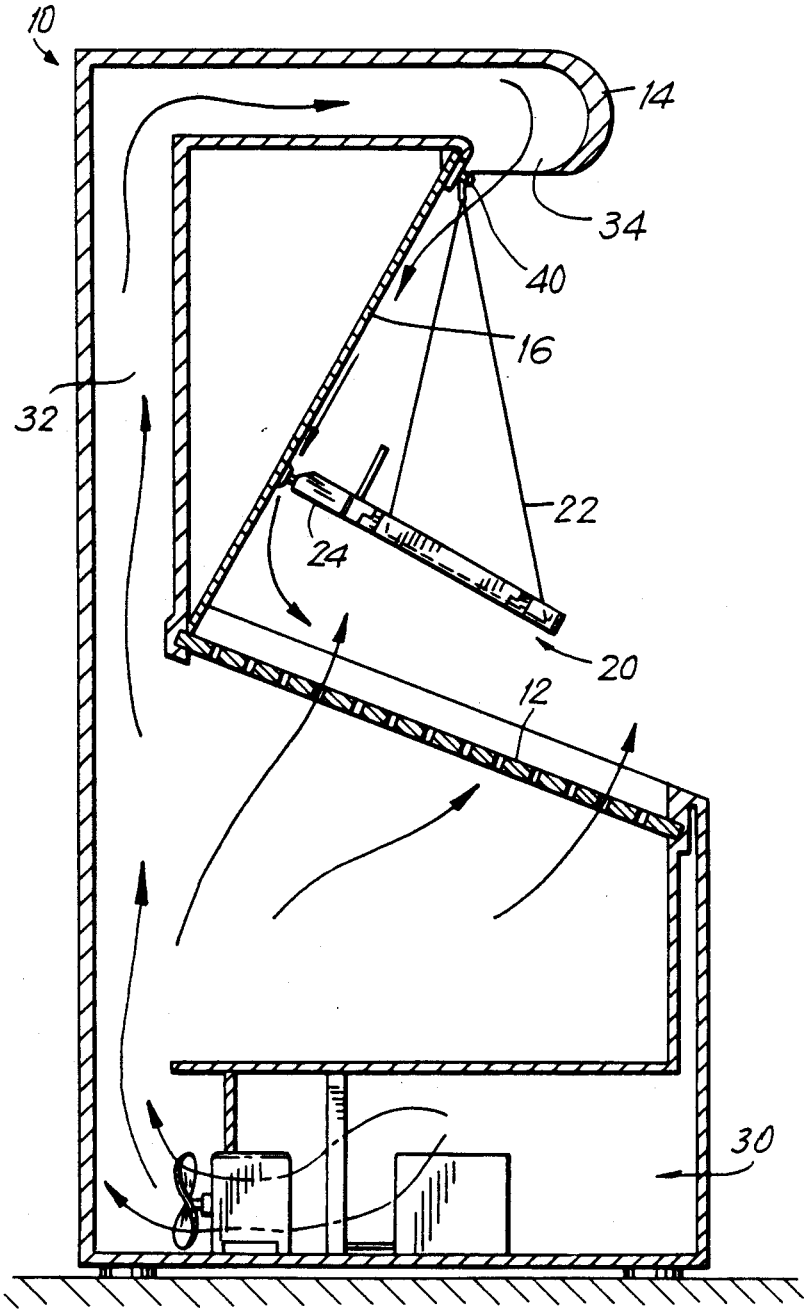
FIG. 4 is a cross-sectional view similar to FIG. 3 showing the shelf suspended in a second position.

On the other hand, in FIG. 4 auxiliary tray 20 is arranged to be at an angle with the floor and parallel to the main produce tray 12, thereby forming a right angle with mirror 16. The manner by which the of auxiliary shelf 20 can be so adjusted will be described hereinbelow.

Figure 5:
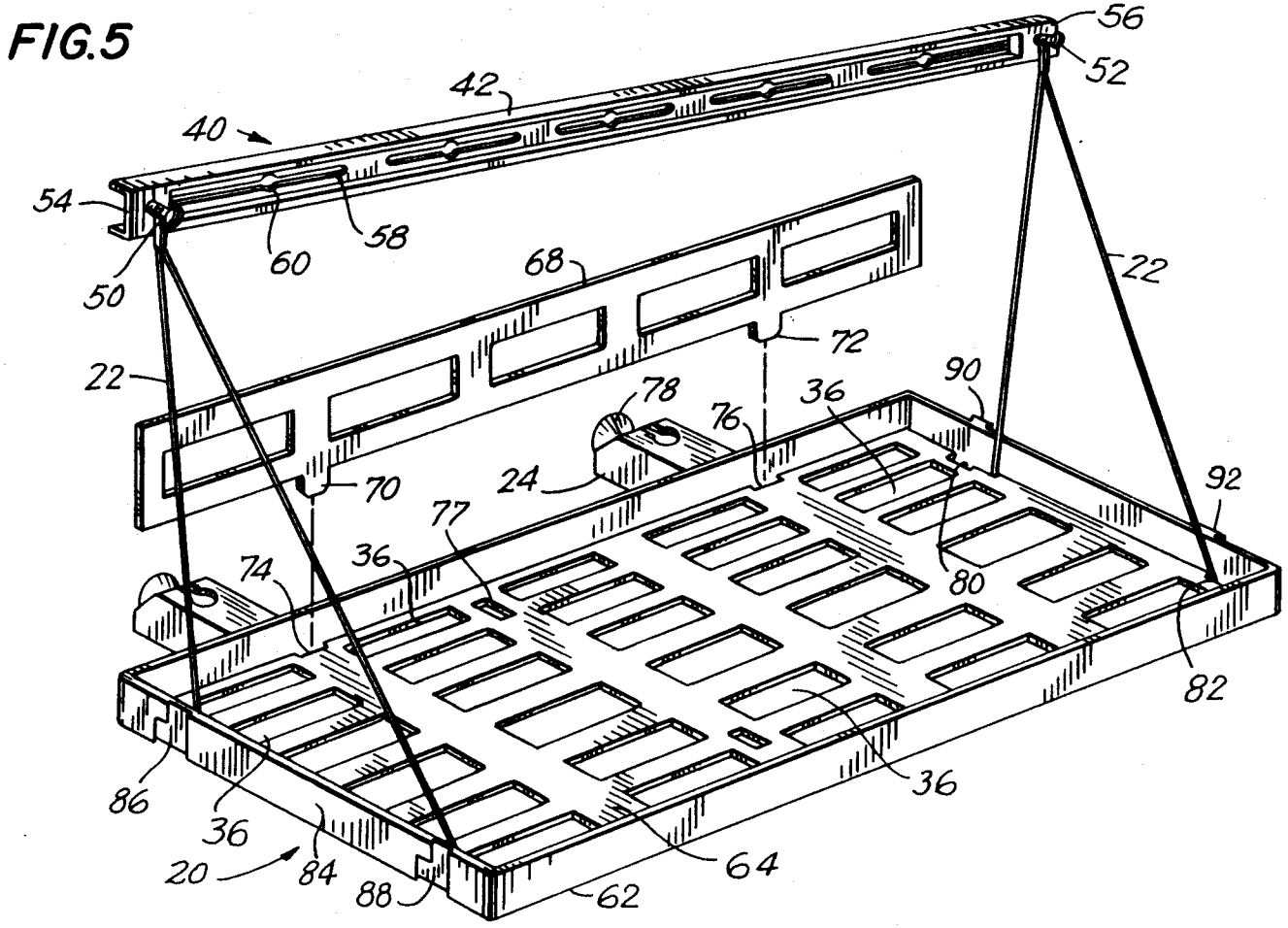
FIG. 5 is a perspective view of the inventive shelf showing the mounting bracket.

In the case of both FIGS. 3 and 4, the monofilament lines 22 are connected to an upper mounting bracket 40, which is attached in the vicinity of the upper edge of mirror 16 and which is shown in more detail in FIG. 5.

Referring then to FIG. 5, mounting bracket 40 is provided as an elongated channel 42 that may be formed of either corrosion resistant steel or plastic in which the monofilament lines 22 are affixed to hanging pegs 50 and 52 located at each end of bracket 40. Hanging pegs 50 and 52 may further be mounted on slideable elements 54 and 56, respectively, that may slide along the length of channel 42 to provide further adjustment. One end of channel 42 behind element 54 is provided with suitable clearance to receive outboard end of an adjacent channel 42. Therefore a number of brackets 40 can be mounted to appear as a continuous strip. Channel 42 is provided with a number of slots 58 arranged along the length thereof that are substantially identical with each slot having a larger diameter center opening 60. According to the present invention, bracket 40 may be mounted on the existing retaining bracket that holds the upper edge of mirror 16 by backing out the existing screws holding that retaining bracket and then placing the enlarged holes 60 over the heads of the respective screws and sliding the bracket 40 either right or left, thereby causing the bracket to be captured by the screws and slots 58. The screws can be retightened to firmly affix bracket 40 at the top of mirror 16. Alternatively, suitable self-tapping metal screws or the like could simply be inserted through holes 60 and affirmly affixed to the typically perforated metal that is arranged above the top edge of mirror 16. In any event, provision of the slots 58 not only aids in the mounting of the shelf using existing holes but also permits lateral adjustment of the shelf. Of course, there are various methods available for fastening bracket 40 above the produce case.

As seen in FIG. 5, shelf 20 comprises a relatively flat tray-like structure 62 having a floor 64 that is generally perforated by a number of slots or openings, shown typically at 36. The tray 62 has four upstanding sides whose height may be determined in part by the type of goods to be displayed thereon. An additional, heightened rear-wall element 68 is provided that has tabs 70 and 72 that fit into respective slots 74 and 76 formed in tray bottom 64 near the rear side. As can be appreciated, rear wall 68 can be arranged at the front of the tray as well in slots similar to 74 and 76, not shown in FIG. 5. In addition, by means of the tabs 70, 72 and slots 74, 76, rear wall 68 can be removed as desired depending upon various applications. Similar walls or dividers can be arranged transversely on the tray by arranging the tabs of such dividers (not shown) in slots, such as shown typically at 77. Standoff elements 24 extend from the rear of the tray 62 and each has arranged at its rear-most end, a rubber bumper 78 that may be in the form of a suction cup for providing a suitable adhesion point to the slanted mirror 16 of the refrigerated produce case 10.

The monofilament suspension elements or lines 22 feed through slots 80 and 82 in floor 64. Slots 80 and 82 are shown at the right-hand side of the inventive tray 20 in FIG. 5, and it is understood that similar slots are provided on the left-hand side of the tray through which the monofilament lines on that side can pass. The manner in which these monofilament lines 22 are secured beneath tray 62 is shown in more detail in FIG. 6.

As shown in FIG. 2, the present invention contemplates the use of several auxiliary trays 20 arranged in conjunction with one another along the length of the refrigerated produce case 10. The use of multiple trays is facilitated by the present invention by providing a tongue-and-groove or dovetail arrangement so that the successive individual shelves may be positively locked one to the other. In that regard, in side wall 84 of tray 62 are formed two dovetail-shaped indentations or grooves 86 and 88 and formed in at the other wall 86 of tray 62 are two dovetail-shaped projections 90 and 92. Projections 90 and 92 are received in the recesses that correspond to grooves 86 and 88 in the next adjacent tray when multiple trays are provided. It is understood that the dovetail projections and grooves are intended to be slid together and positively locked one to another.

Figure 6:
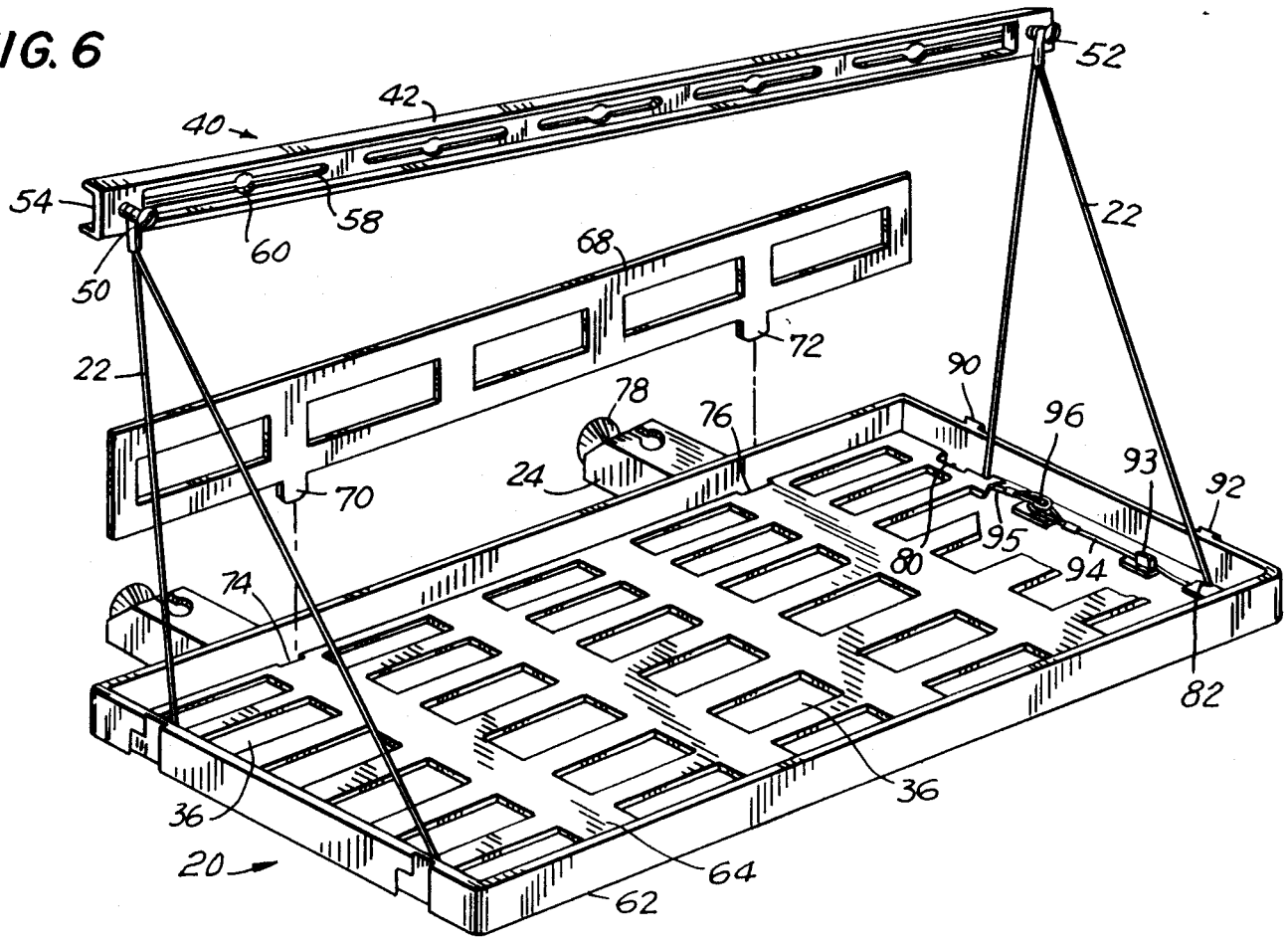
FIG. 6 is a perspective view of the inventive shelf and mounting bracket with a portion of the floor of the shelf broken away to show the suspension adjustment elements.

Turning then to FIG. 6, which is a perspective view as in FIG. 5 in which a portion of floor 64 of tray 62 has been broken away so that the manner in which monofilament lines 22 are attached can be shown. Specifically, it is seen that one end 95 of monofilament line 22 is passed through the first slot 80 in tray floor 64 and is then captured around a T-shaped or pedestal-shaped attachment projection 96 that is fixed to the bottom surface of tray floor 64, which has been cut away in FIG. 6. End 95 of monofilament line 22 can be formed into a loop to facilitate placement over attachment projection 96. Similarly, the other end 94 of monofilament line 22 is passed through slot 82 and the loop formed therein can be also placed around T-shaped attachment projection 96. Accordingly, by affixing the monofilament line 22 located at the other end of the tray in the same fashion, the extent to which the tray may tilt relative to the mounting bracket 40 is fixed. In this embodiment of the present invention also provided is an L-shaped attachment projection 93 that in the operating position shown in FIG. 6 does not have either end 95 or 94 of monofilament line 22 attached to it. Thus, by removing the end 94 from T-shaped element 96 and connecting it to L-shaped attachment projection 93 thereby lengthening the distance between element 52 and element 82 while leaving the distance between element 52 and element 80 unchanged, it is seen that the front edge of the tray 62 is permitted to be adjusted downwardly relative to bracket 40, so as to assume the operating position shown in FIG. 4, for example. On the other hand, by having the monofilament line 22 adjusted as shown in FIG. 6, the operating position as shown in FIG. 3 can be assumed.

It should be understood, of course, that the foregoing description is present by way of example only and that various other constructions and arrangements are possible in keepinq with the present invention, for example, monofilament line 22 can be attached in various ways to different hooks and hook-like attachment projections arranged along the bottom surface of the tray to provide various operating orientations of the tray surface relative to the mounting bracket in addition to the two specific positions shown herein. Similarly, although the tray is shown in a generally rectangular shape, it could be square or even assume a rounded shape. In addition, while standoffs are shown as protruding from the rear surface toward the middle of the tray, the standoffs could be at either corner or could be integrally formed by removing large scalloped areas at the back of the tray. Furthermore, the present invention does not require the presence of a mirror, only an upraised panel at the back of the main shelf from which to suspend the auxiliary shelf.

The above description is given on a single preferred embodiment of the present invention, but it will be apparent that many modifications and variations could be effected by one skilled in the art without departing from the spirit or scope of the novel concepts of the invention, which should be determined by the appended claims.

I claim:

1. An auxiliary shelf for installation on a counter having a main shelf and an upright backing panel, comprising:

a flat rigid tray including a plurality of holes in a bottom thereof to allow air flow through the tray and to allow suspension lines to pass therethrough, attachment means arranged on a bottom surface of said tray, and walls along each edge of said tray;

a single, elongate mounting bracket means adapted to be fastened to a backing panel and extending substantially parallel to a rear wall of said tray for a length substantially equal to a length of said rear wall of said tray and having perforations therein for use in fastening said mounting bracket to an upper edge of a backing panel of a counter; and a plurality of suspension lines connected between said bracket means and said tray for suspending said tray over a main shelf of a counter, each of said plurality of suspension lines passing through a respective one of said plurality of holes in said tray and being affixed to said attachment means arranged on the bottom surface of said tray.

2. An auxiliary shelf according to claim 1, in which said plurality of suspension lines comprises a pair of lines at a right-side of said tray and a pair of lines at a left-side of said tray.

3. An auxiliary shelf according to claim 2, in which said attachment means comprises two attachment projections arranged along a left-side of the bottom of said flat tray and two attachment projections arranged along a right-side of the bottom of said flat tray, and said attachment projections being adapted to have ends of said pairs of lines attached thereto.

4. An auxiliary shelf according to claim 1, in which said elongate mounting bracket includes hanging pegs formed at each end thereof for connection to a respective one of said plurality of suspension lines and wherein each of said plurality of suspension lines has a loop formed at each end thereof for placement over respective ones of said attachment projections.

5. An auxiliary shelf according to claim 1, in which said elongate bracket includes hanging pegs formed at each end thereof and wherein each of said plurality of suspension lines has a loop formed proximate the middle thereof for placement over a respective one of said hanging pegs.

6. An auxiliary shelf according to claim 1, in which said bracket has a plurality of clearance slots for receiving fastening elements for fastening said bracket to the backing panel of the counter.

7. An auxiliary shelf according to claim 6, in which said each of said slots has an aperture of increased diameter formed at a mid-point there along for receiving a fastening element for fastening said bracket to the backing panel of the counter.

8. An auxiliary shelf for installation on a counter having a main shelf and an upright backing panel, comprising:

a flat tray including attachment means arranged thereon;

an elongate mounting bracket means adapted to be fastened to a backing panel and extending parallel to a rear wall of said tray and having perforations therein for use in fastening said mounting bracket means to an upper edge of a backing panel of a counter, wherein said bracket means is formed as a channel and further includes slidable elements arranged for sliding engagement in said channel and each of said slidable elements including a hanging peg affixed thereto for engagement with a suspension line; and a plurality of suspension lines connected between a respective hanging peg on said bracket means and said attachment means on said tray for suspending said tray over a main shelf of a counter.

9. An auxiliary shelf for installation on a counter having a main shelf and an upright backing panel, comprising:

a flat tray including attachment means arranged thereon;

an elongate mounting bracket means adapted to be fastened to a backing panel and extending parallel to a rear wall of said tray and having perforations therein for use in fastening said mounting bracket means to an upper edge of a backing panel of a counter, wherein one end of said bracket is provided with a clearance to receive and outboard end of an adjacent bracket means; and a plurality of suspension lines connected between said bracket means and said tray for suspending said tray over a main shelf of a counter, each of said plurality of suspension lines being affixed to said attachment means on said tray.

10. An auxiliary shelf for installation on a counter having a main shelf and an upright backing panel, comprising:

a flat tray including attachment means arranged thereon and a plurality of elongate standoff elements extending outwardly beyond a rear side thereof that is proximate a backing panel of a counter upon installation of said auxiliary shelf, said plurality of standoff elements being substantially in the plane of said tray and arranged for contacting a backing panel of a counter so that the rear side of said tray is spaced apart from a backing panel of a counter;

an elongate mounting bracket means adapted to be fastened to a backing panel and extending parallel along said rear side of said tray and having perforations therein for use in fastening said mounting bracket means to an upper edge of a backing panel of a counter; and a plurality of suspension lines connected between said bracket means and said tray for suspending said tray over a main shelf, each of said plurality of suspension lines being affixed to said attachment means on said tray.

11. An auxiliary shelf according to claim 10, in which a plurality of resilient bumper elements are arranged at free ends of each of said plurality of elongate standoff elements, said bumper elements contacting a backing panel of a counter upon installation of said auxiliary shelf.

12. An auxiliary shelf according to claim 11, in which said bumper elements comprise suction cups.

13. An auxililary shelf according to claim 1, further comprising an upraised rear wall element for attachment to said tray along said rear side thereof.

14. An auxiliary shelf according to claim 13, in which said upraised rear wall element has tabs formed thereon for engagement with respective slots formed in said tray.

15. An auxiliary shelf according to claim 1, wherein said tray further comprises male and female engagement means arranged along a left and right-side thereof, respectively, said male and female engagement means being adapted for engagement with an engagement means of an opposite kind.

16. An auxiliary shelf according to claim 15, in which said male engagement means comprises a dovetail-shaped projection for cooperating with dovetail-shaped recess in an adjacent auxiliary shelf and said female engagement means comprises a dovetail-shaped recess for cooperating with a dovetail-shaped projection on an adjacent auxiliary shelf.

* * * * *